United States Patent [19]

Fukushima et al.

[11] Patent Number: 4,515,352

[45] Date of Patent: May 7, 1985

[54] ROTARY FURNACE USED FOR THE PRODUCTION OF FERROCHROMIUM

[75] Inventors: Tsutomu Fukushima; Kiyoshi Kawasaki; Sadayuki Sasaki, all of Yokohama, Japan

[73] Assignee: Nippon Kokan Kabushiki Kaisha, Tokyo, Japan

[21] Appl. No.: 519,901

[22] Filed: Aug. 3, 1983

Related U.S. Application Data

[62] Division of Ser. No. 403,049, Jul. 29, 1982, Pat. No. 4,414,026.

[30] Foreign Application Priority Data

Jul. 30, 1981 [JP] Japan ..... 56-118500
Jul. 31, 1981 [JP] Japan ..... 56-119291

[51] Int. Cl.[3] ..... C21C 5/48

[52] U.S. Cl. ..... 266/218; 75/34; 266/220; 266/248

[58] Field of Search ..... 266/218, 220, 248, 173; 75/34, 130.5

[56] References Cited

U.S. PATENT DOCUMENTS

| | | | |
|---|---|---|---|
| 3,185,464 | 5/1965 | Meyer | 75/34 |
| 3,206,299 | 9/1965 | Senior | 75/34 |
| 3,254,986 | 6/1966 | Thorpe | 75/34 |
| 3,331,679 | 7/1967 | Schenck | 75/34 |
| 3,791,819 | 2/1974 | Loutzenhiser | 75/130.5 |
| 3,912,501 | 10/1975 | DeCastejon | 75/11 |

FOREIGN PATENT DOCUMENTS

| | | |
|---|---|---|
| 40-13043 | 6/1965 | Japan . |
| 44-23731 | 10/1969 | Japan . |
| 23731 | 10/1969 | Japan . |
| 56-46149 | 3/1981 | Japan . |
| 56-46150 | 3/1981 | Japan . |
| 56-46151 | 3/1981 | Japan . |
| 162788 | 10/1982 | Japan . |

*Primary Examiner*—Peter D. Rosenberg
*Attorney, Agent, or Firm*—Fleit, Jacobson, Cohn & Price

[57] ABSTRACT

Described is a method for the production of ferrochromium and a rotary furnace employed in such method. Raw chromium ores, fluxes and carbonaceous reducing agent(s) are charged into a rotary furnace into which oxygen or oxygen-enriched air are blown to effect smelting reduction. The layer height of the carbonaceous reducing agent and the time interval during which the layer height should be kept are specified, the reducing agent is used in circulation, while exhaust gases are utilized for pre-heating and pre-reducing of the materials for saving the energy considerably in contrast to the conventional method. The rotary furnace has plural gas-blowing, small holes passing through the furnace shell and the refractory lining. These holes may be arranged as a dual pipe whereby cooling air, fuel or a fuel-oxygen mixture may be blown or an oxidizing gas and a cooling gas such as argon may be blown through the inner pipe and the outer pipe respectively.

8 Claims, 26 Drawing Figures

(a)

(b)

(C)

ROTARY FURNACE USED FOR THE PRODUCTION OF FERROCHROMIUM

This is a divisional of application Serial No. 403,049 filed July 29, 1982 now Pat. No. 4,414,026.

BACKGROUND OF THE INVENTION

This invention relates to a method for the production of ferrochromium with use of a rotary furnace. More particularly, it relates to such method wherein expensive electric power is not used as in the conventional electric furnace method but a carbonaceous reducing agent such as coke or coal is burned in the rotary furnace in the presence of oxygen and raw chromium ores pre-heated or pre-reduced and charged into the rotary furnace are turned under the heat of combustion into ferrochromium by smelting reduction, and to the rotary furnace that may be used for smelting a variety of raw materials including those employed for production of ferrochromium.

Heretofore, in the production of high carbon ferrochromium, the raw materials including raw chromium ores, reducing agent such as coke and fluxes such as lime or silica are charged consecutively into a submerged arc type electric furnace for smelting. By this method, an electric power of 3000 to 3700 KWH is required per each ton of ferrochromium which means a considerable electric power consumption. In consideration of the markedly inferior conversion efficiency from the valuable liquid fuel to electric energy, it is nowadays of vital importance to develop a technique whereby the consumption of a large quantity of electric power may be avoided.

From this standpoint, various methods for the production of ferro-alloy or alloy steels by smelting reduction through use of a rotary furnace, and the rotary furnace used in these methods, have been proposed e.g. in the Japanese Patent Publication Nos. 13043/1965 and 23731/1969. The Japanese Patent Publication No. 13043/1965 shows the method for smelting reduction of the ores in a rotary furnace by using solid reducing agent such as coal and coke. In this method, however, the ores are limited to iron ores and the upper limit of the smelting temperature is set up to 1450° C. for protection of the refractory material. In spite of such limitation, in case of reduction of iron oxides, the refractory material may be attacked by molten iron oxides yielded in the smelting process. Because of this problem, the method of the Publication No. 13043/1965 has not been practiced commercially.

The Japanese Patent Publication No. 23731/1969 shows the method for production of ferro-alloys or alloy steels through smelting reduction making use of a rotary furnace. With this method, the heat source for smelting is limited to oxygen-natural gas or heavy oil or oxygen-carbon monoxide yielded by reducing reactions. Hence it is not possible to use coke or coal which may be readily available at lower costs. It is stated that the materials can be pre-heated or pre-reduced by exhaust gases from a reducing furnace, however, no mention has been made of the method or apparatus for utilizing such exhaust gases.

Moreover, in these known methods, coal, coke or graphite is used as a reducing agent, and the thickness of the layer of reducing agent on the slag surface is set to 30 to 50 mm, leading to a weaker reducing atmosphere and low yield rate. For instance, in case of the production of ferrochromium, Cr yield rate is only about 73 percent. Moreover, in the known methods, the oxygen blow lances are directed upwards or horizontally so that combustion takes place near the refractory material, leading to increased rate of heat radiation or conduction from the refractory material and lower heat efficiency. Moreover, in the case of smelting process where the constant slag temperature should be kept at a constant, the refractory material may be exposed to extremely high temperatures, resulting in increased consumption of the material. Moreover, five metal particles suspending in the discharged reducing agent might not be utilized effectively, resulting to the low yield rate mentioned above.

In addition, in a rotary furnace and as shown in the Japanese Patent Publication No. 23731/1969, oxygen—natural gas or heavy oil or oxygen-carbon monoxide yielded by reducing reactions is blown from a lance towards the refractory ceiling while the furnace which containing charge is rotated about its axis. The charges are smelted by radiation from refractory ceiling heated up by combustion taking place in the furnace.

These rotary furnaces have many practical inconveniences such as mentioned below.

(a) It is not possible to use coal or coke that is available readily at lower costs.

(b) The test results show that the refractories in the furnace may be attacked severely by the slags when the surface temperature thereof has exceeded 1900° C., resulting in acute increase in the consumption of the refractories. With the above known furnace, since the surface temperature of the refractory may reach 2000° C. or higher, consumption of the refractory may increase severely and there arises the necessity for frequently replacing the refractory, thus elevating repair costs and down time for repair.

(c) Smelting may be prolonged because the charges are smelted by radiation heat from the refractories.

(d) The metal yielded may be saturated with carbon used as reducing agents.

In view of these inconveniences, the present invention envisages to provide a rotary furnace in place of the electric arc furnace of the prior art for smelting not only ferrochromium but various other materials and to provide a method for the production of ferrochromium wherein total energy consumption of the process may be reduced by about 25 percent as compared to the electric furnace method through (a) using coal and coke that are available at reduced costs, (b) preventing overheating of the refractories in the in the furnace and reducing their consumption, (c) blowing fuel and oxygen for promoting the smelting of the raw materials, shortening the blowing time and improving the productivity, (d) decarburnizing the yielded metal for repeated use, (e) utilizing exhaust gases of the rotary further for preheating of pre-reducing of the raw ores for recovery of waste heat.

Summary of the Invention

The present invention resides in a method for the production of ferrochromium characterized in that raw chromium ores, fluxes and carbonaceous reducing agent(s) are charged into a rotary furnace having a horizontal or gently sloped axis and smelting reduction is caused to take place while oxygen or oxygen-enriched air is blown into the furnace.

Preferably, the layer of the reducing agent is kept at a thickness larger than 50 mm, and such thickness of the layer is kept for a time interval equal to over 70 percent of the total blowing time or over at least 15 minutes preceding termination of blowing operation. Preferably, the carbonaceous reducing agent is used cyclically, and oxygen is blown through a downwardly directed lance for combustion of the carbonaceous reducing agent and directly affording the heat of combustion to the surface of molten bath. Hot exhaust gases from the rotary furnace may be conducted to a rotary kiln, shaft furnace or a fluidized bed for pre-heating or pre-reducing of the charges and the raw chromium ores. The rotary furnace has plural small holes passing through furnace wall and opening into furnace inside. These holes are of a dual pipe structure and used for blowing of gases into the furnace.

DESCRIPTION OF THE PREFERRED EMBODIMENT

The method for the production of ferrochromium with use of the rotary furnace of the present invention will now be described in detail.

Raw Cr-Ores such as fine and lumpy ores, and Cr-ore agglomerate such as pellets and briquetts (also carbon-containing agglomerate) could be charged in the present invention. By carbonaceous reducing agents are meant coke, coal, mixtures of coke and coal, mixtures of coke and coal, mixtures of coke and coal with sulverized coal injection or a water-coal slurry injection.

Figure 1:
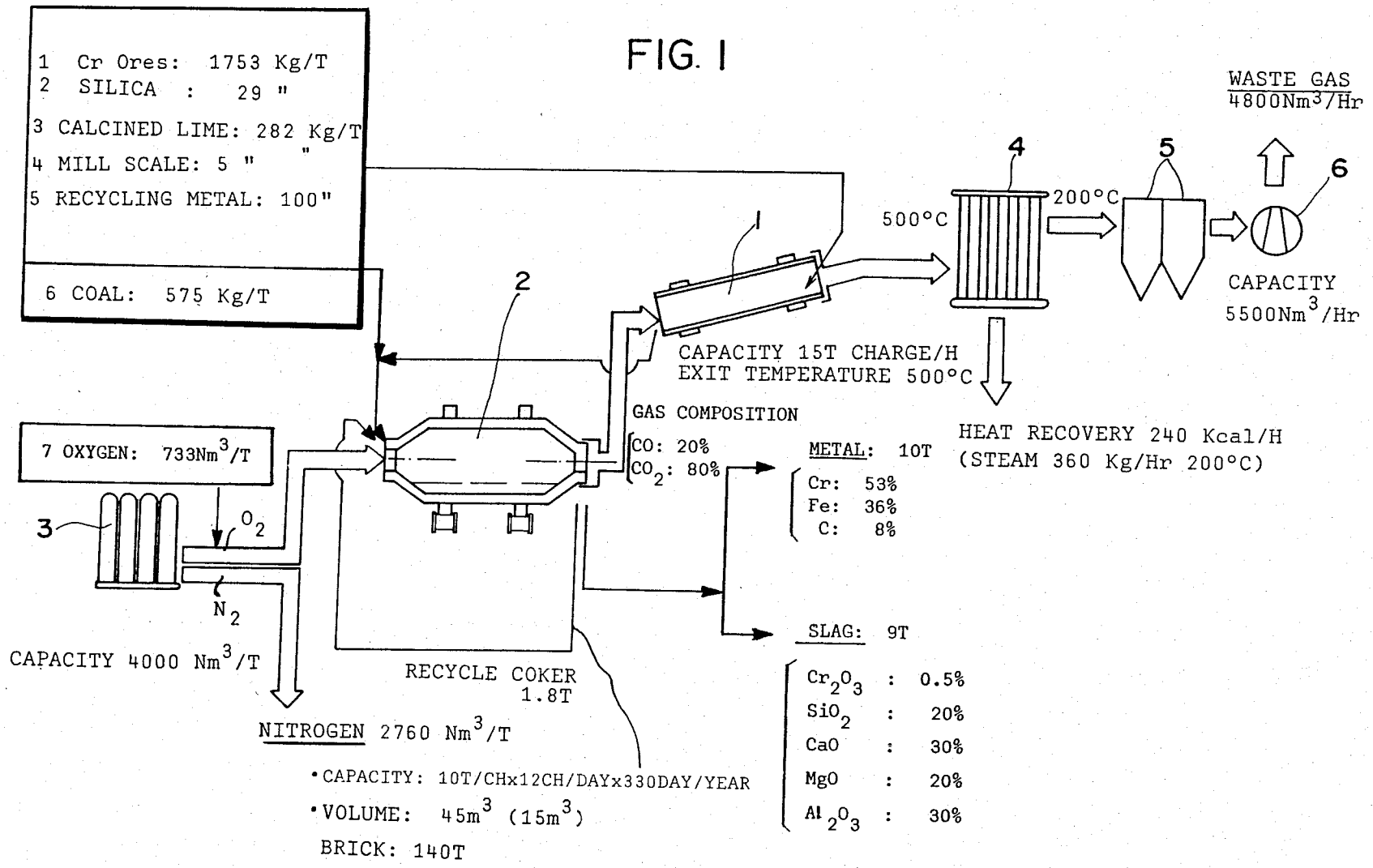
FIG. 1 is a diagram showing the basic process of the present invention.

An example of the method for production of ferrochromium will be described in accordance with the process diagram shown in FIG. 1, which is a basic process diagram of the present invention. The numeral 1 denotes a rotary kiln for pre-heating or pre-reduction of raw chromium ores. The rotary kiln may be replaced by any other furnace such as shaft furnace or fluidized bed provided that such furnace allows to keep the heating temperature up to 1800° C. necessary for such pre-heating or pre-reduction. As raw chromium ores to be charged into rotary kiln 1, lumpy and/or fine chromium Ores, fired or cold-bonded pellets or briquettes, could be used, silica, limestone (calcined lime or quick lime) or mill scale are also charged as fluxes. FIG. 1 shows the recorded values obtained from test operation. The heat supplied to the rotary kiln 1 is derived from exit gases at 1200° to 1250° C. exhausted from a rotary furnace 2 to be described later and composed of about 20 percent of CO and 80 percent of $CO_2$. In the present Example, these gases are burned further in the rotary kiln so as to be the source of pre-heating. The rotary furnace 2 shown is the horizontal rotary furnace opened at both ends, but the furnace maybe opened at one end only or tilted with a maximum tilt angle of 35 degrees. The raw chromium ores and fluxes which have undergone pre-heating or pre-reduction in the rotary kiln 1 are charged directly into the rotary furnace, at the same time that solid fuel reducing agents are also charged into the furnace where oxygen or oxygen-enriched air is also supplied under pressure for smelting and reducing the materials for production of ferrochromium and slags. As typical of the solid fuel reducing agent(s), charged into the rotary furnace, coke, coal mixture of coke and coal, mixtures of coke, and coal with pulverlized coal injection or coal water slurry or emulsion injection may be mentioned. In the drawing, 3 denotes an apparatus for preparation of oxygen, 4 a heat exchanger, 5 an electrical dust precipitator and 6 a suction type fan. According to the present invention, exhaust gases from a rotary furnace are used as heat source for pre-heating or pre-reduction. The exhaust gases from a furnace used for such pre-heating or pre-reduction, such as rotary kiln, are passed through heat exchanger (4) for heat recovery and through electrical dust precipitator (5) for dust removal. According to the fundamental process of the invention, shown schematically in FIG. 1, the above mentioned objects of the present invention may be attained for various kinds of ferrochromium or pre-reducing furnaces, the type of inlet means to the rotary furnace and presence or absence of tilt of the rotary furnace according to respective Examples as tabulated in Table 1. However, the effects of the present invention may be demonstrated most conspicuously be using a rotary furnace having plural small openings through the furnace wall according to one aspect of the present invention.

TABLE 1

Figure 2:
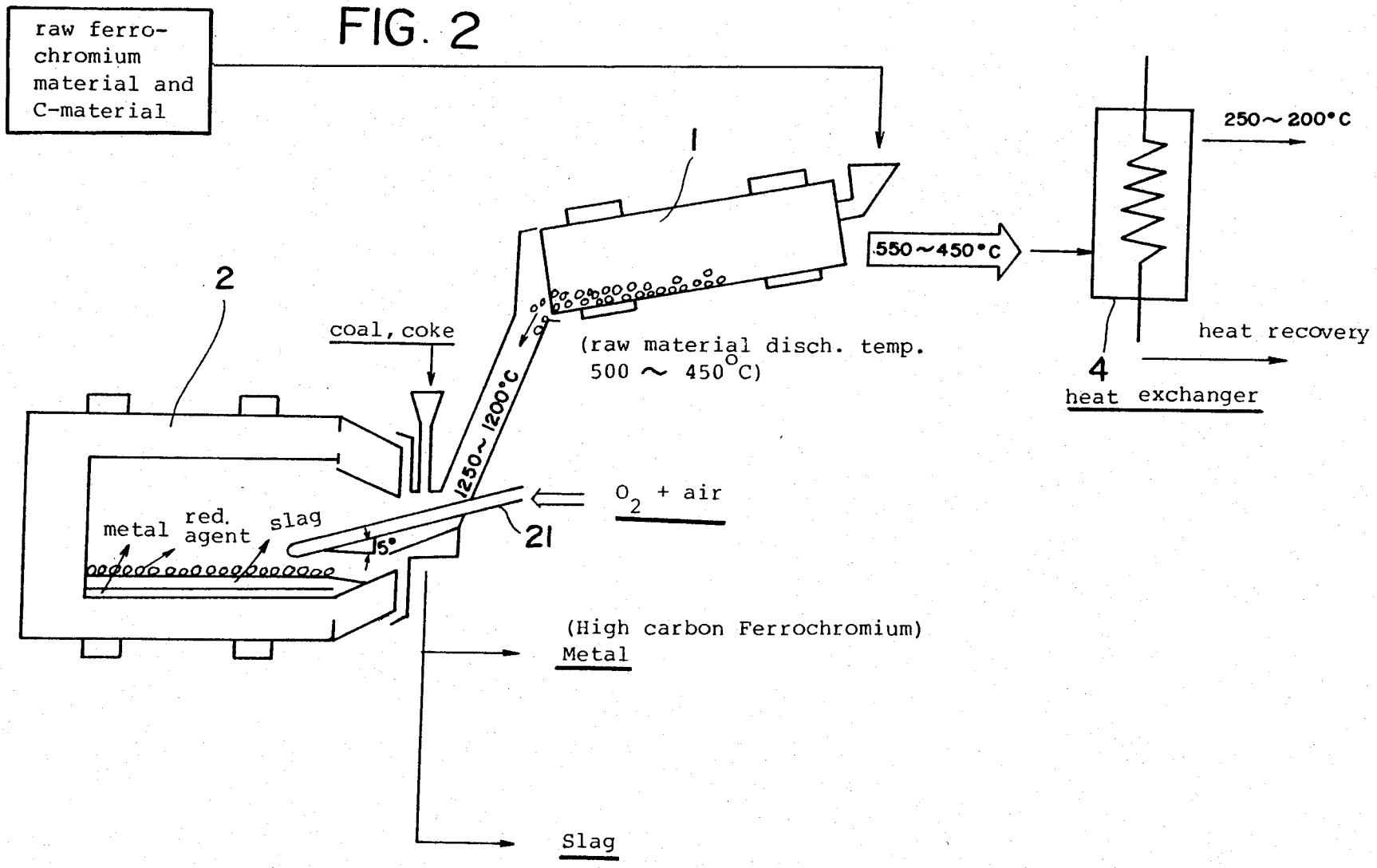
FIG. 2 is a diagram showing the process of the first embodiment of the invention.
Figure 3:
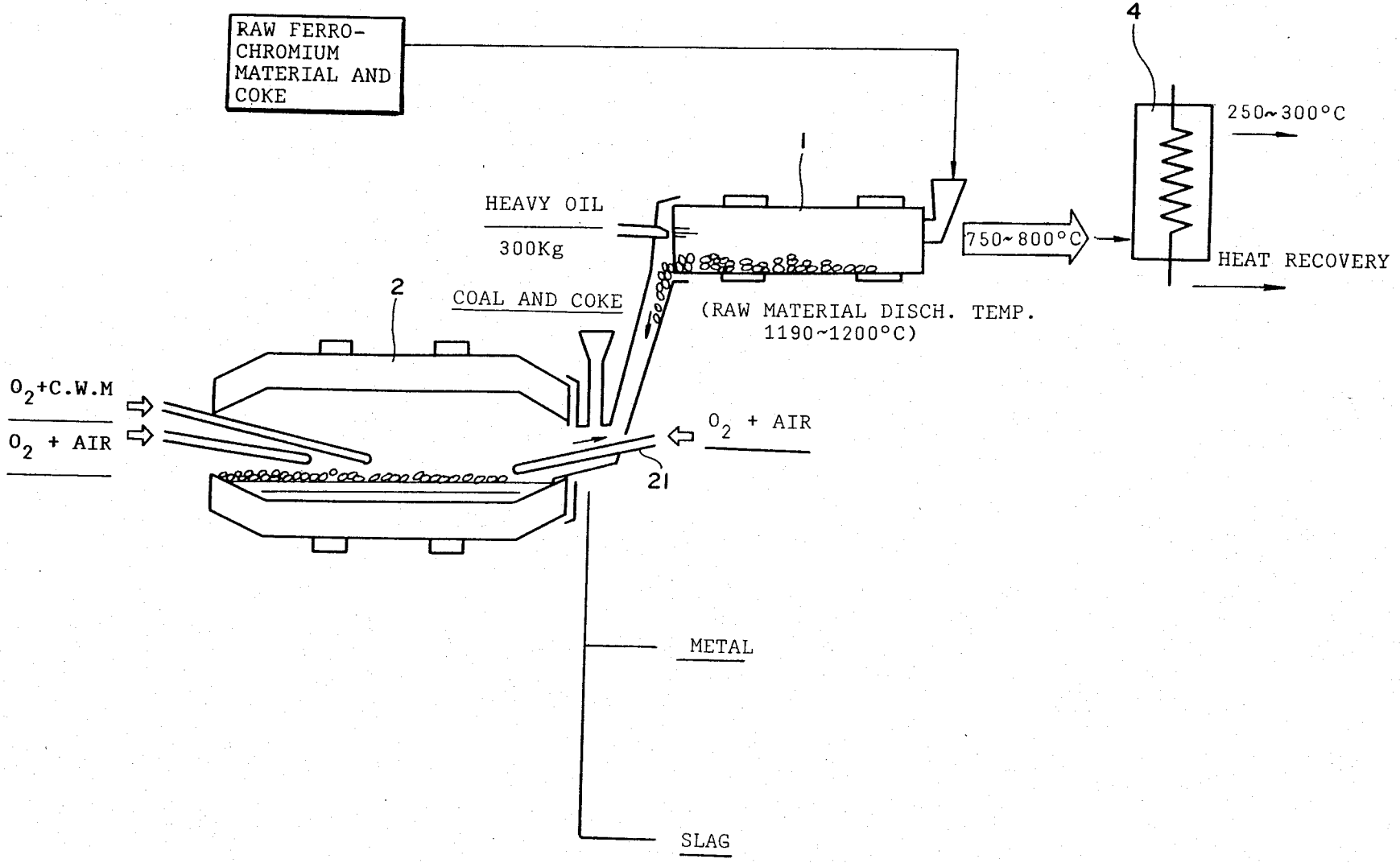
FIG. 3 is a diagram showing the process of the second embodiment of the invention.
Figure 5:
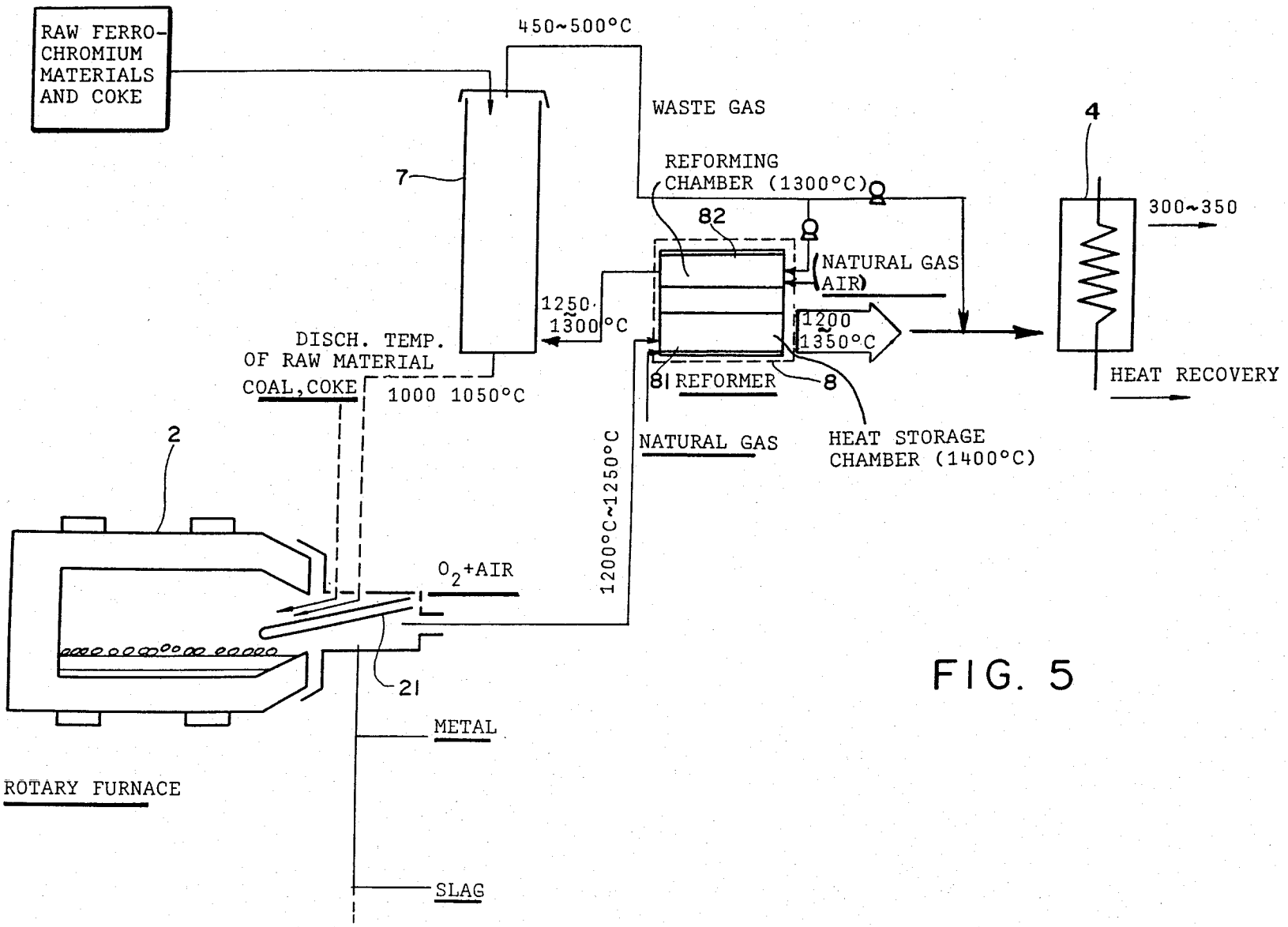
FIG. 5 is a diagram showing the process of a third embodiment of the invention.
Figure 14:
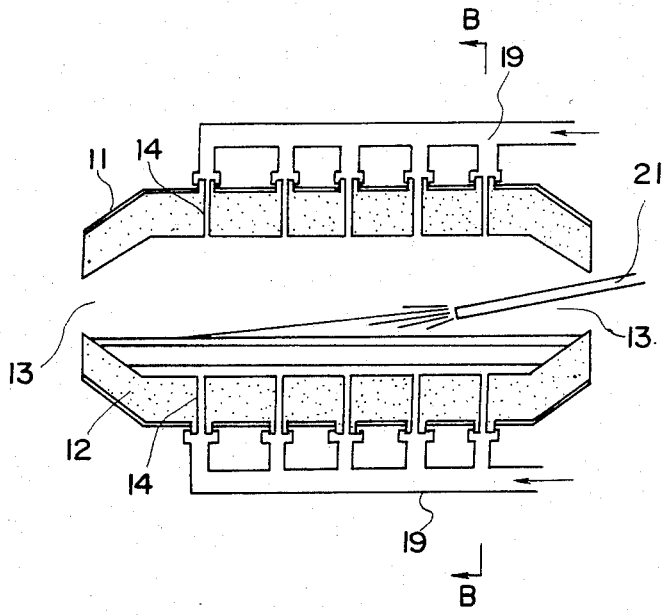
FIG. 14 is a longitudinal section of the furnace according to a sixth embodiment of the invention.
Figure 17:
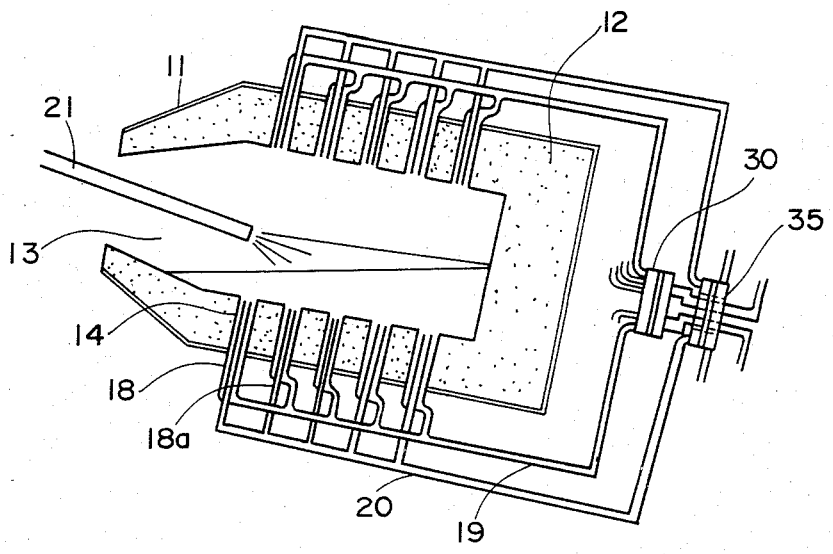
FIG. 17 is a longitudinal section of a rotary furnace according to a seventh embodiment of the invention.

| | Example 1 | Example 2 | Example 3 | Example 4 | Example 5 | Example 6 | Example 7 |
|---|---|---|---|---|---|---|---|
| Kinds of Ferro-chromium | high carbon ferrochromium | high carbon ferrochromium | high carbon ferrochromium | high carbon ferrochromium | high carbon ferrochromium | moderate carbon ferrochromium | carbon unsaturated, high carbon ferrochromium |
| Pre-reduction Rotary furnace | rotary kiln horizontal open at one end | rotary kiln horizontal open at one end | rotary kiln horizontal open at one end | rotary kiln tilted 20°, open at one end | rotary kiln tilted 20°, open at one end | preheating inventive rotary furnace horizontal open at | preheating inventive rotary furnace tiltvable open at one end. |
| Drawing No. | FIG. 2 | FIG. 3 | FIG. 5 | FIG. 2 | — | FIG. 14, 15 | FIG. 17 |

Based on the results of these Examples, the present inventor conducted an experiment on the effects on the Cr reduction rate, and arrived at the following finding.

Figure 6:
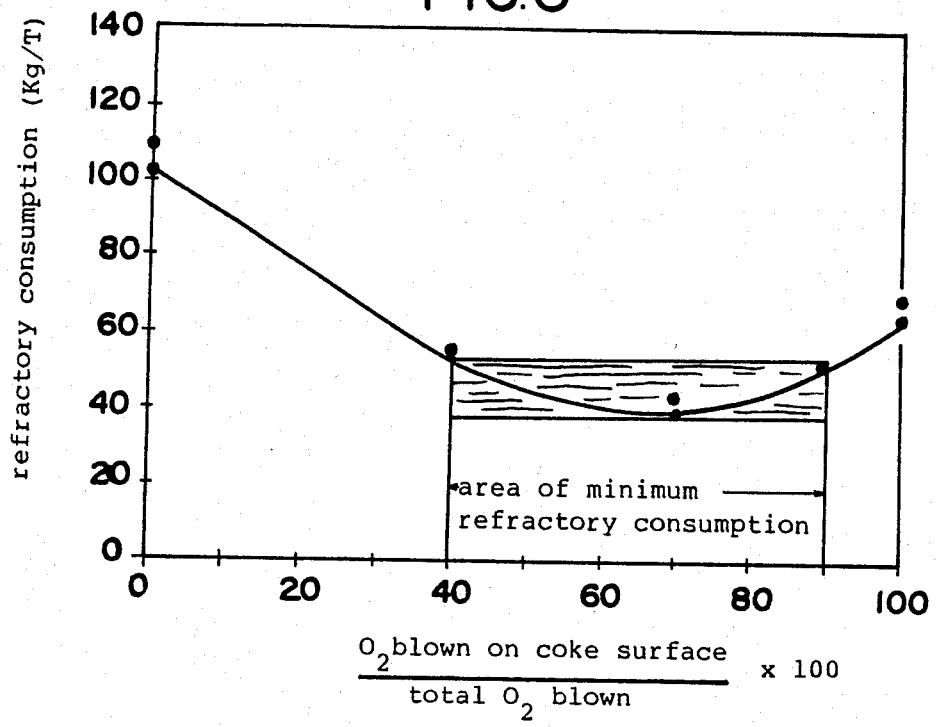
FIG. 6 shows the consumption of the refractories plotted against the ratio of $O_2$ blown onto coke surface in the method of the present invention.
Figure 7:
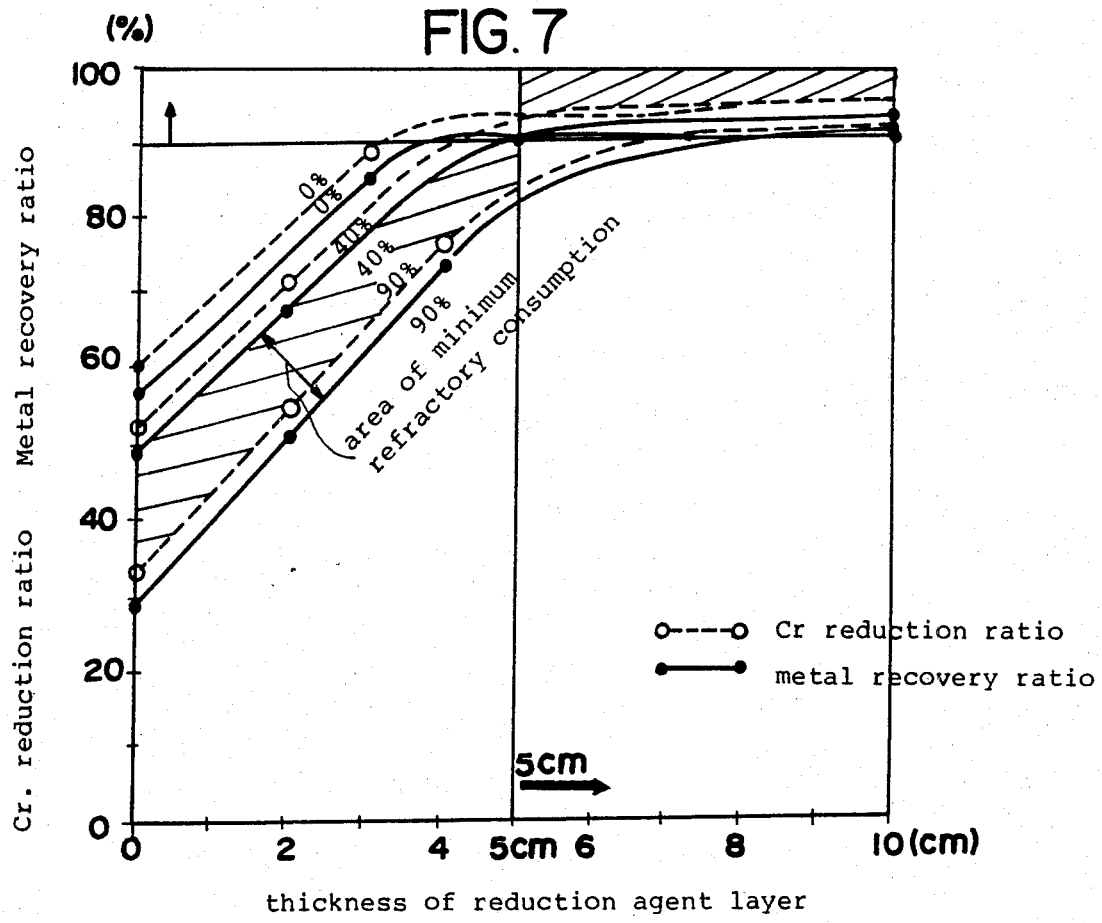
FIG. 7 shows the Cr reduction rate and metal recovery rate plotted against reducing agent layer thickness.
Figure 8:
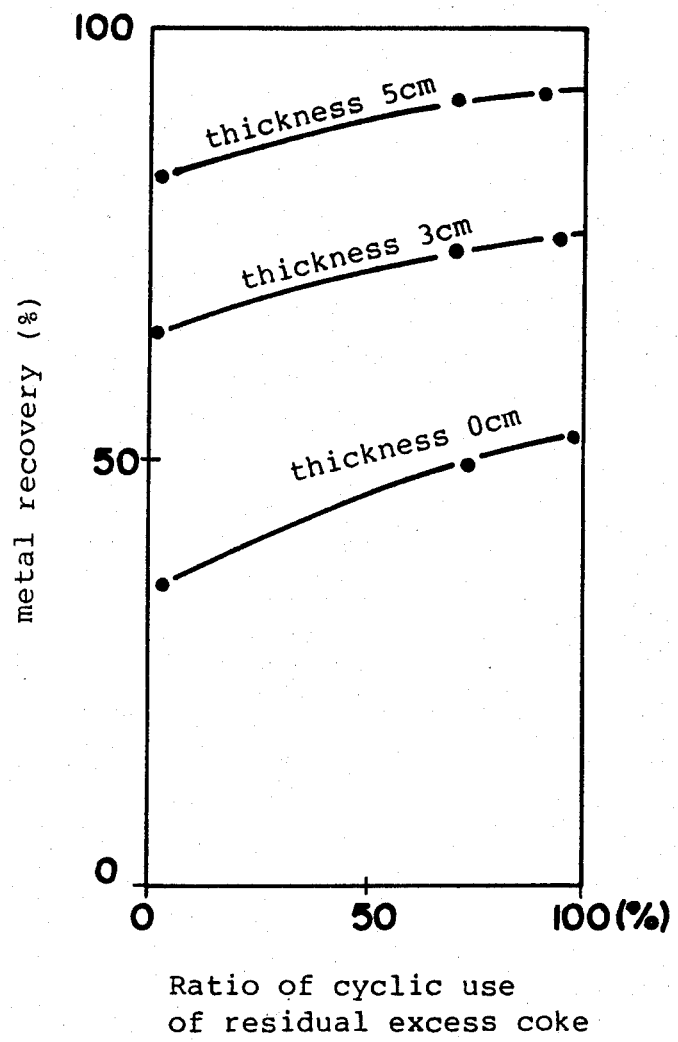
FIG. 8 shows the metal recovery rate plotted against the rate of recirculation of residual excess coke.

FIG. 6 is a chart showing the relation between the $O_2$ blowing ratio on the coke surface. FIG. 7 is a chart howing the relation between the thickness of reduction agent layer and the Cr reduction ratio (metal recovery rate), and FIG. 8 is a graph showing the relation between the rate of cyclic use of residual excess coke and the metal recovery rate. It is seen from FIG. 7 that the layer of reducing agent 50 mm thick or more is required to reduce the consumption of the refractory material and to increase the Cr reduction ratio (metal recovery rate). It is seen from FIG. 8 that the layer thickness of 50 mm or more is preferred in that the metal recovery may then be higher than the rate of cyclic use of residual excess coke. It is also seen from FIG. 6 that consumption of the refractory material may be reduced markedly when oxygen is blown through a downwardly directed oxygen blow lance for burning the carbonaceous reducing agent, and the heat of combustion is afforded directly to the metal surface.

In this manner, thermal efficiency can be improved, markedly when the oxygen lance is directed downwards and the reducing agent is burned on the slag surface for increasing the rate of combustion heat supplied direct to the slag. Since the surface temperature of the refractory material varies with the rate of oxygen flow directed towards the reducing agent, if a downwardly directed bifurcate lance is used for blowing so that 40 to 90 percent of the total oxygen blow is directed downwards, the slag temperature can be kept at 1700° C. or thereabouts without markedly increasing the temperature of the refractory surface. Consumption of the refractory material can also be reduced because the surface of the material is not subjected to heating at elevated temperature.

When the oxygen lance is directed downwards, a weakly reducing atmosphere will prevail for a smaller thickness of the reducing agent, resulting in the lower yield rate. The metal recovery rate higher than 86 percent may be realized by using the layer of the reducing agent thicker than 50 mm for the blow rate of downwardly directed oxygen equal to 40 to 90 percent of the total oxygen blow for which the consumption of the refractory material can be reduced as mentioned above.

At the end of smelting, a large quantity of the reducing agent remains in the furnace and a lot of minute metal particles remain suspending in the surface of the reducing agent. It has been shown that the metal recovery rate can be improved by about 6 percent and raised to 92 percent by providing a skimmer at the tapping hole or mouth so that more than 80 percent of the residual excess reducing agent can be used incirculation.

The inventive method for the production of ferrochromium can be practiced in such a manner that raw chromium ores, fluxes and carbonaceous reducing agent are charged into the conventional horizontal or tiltable rotary furnace which is open at one or both ends and that either oxygen or oxygen-enriched air is blown into the charge for smelting reduction. The present inventor has invented a rotary furnace applicable not only to the present process but to smelting of various other materials.

Figure 11:
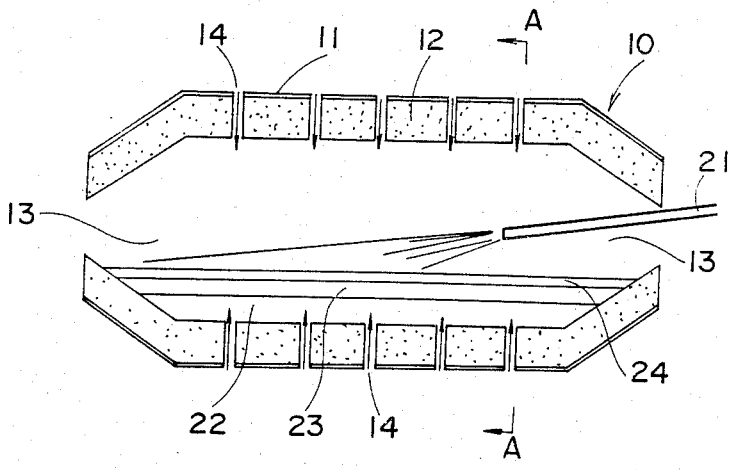
FIG. 11 is a longitudinal section through a rotary furnace of the invention and showing the operating principle thereof.
Figure 12:
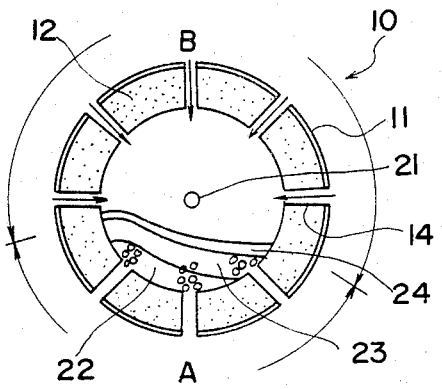
FIG. 12 is a section taken along line A—A of FIG. 11.

FIG. 11 is a longitudinal sectional view showing the principle of the inventive rotary furnace and FIG. 12 is a sectional view taken along line A—A of FIG. 11. In these Figures, the numeral 10 denotes a furnace body, the numeral 11 an furnace shell the numeral 12 an inner refractory lining and the numeral 13 an oxygen and raw material inlet an both sides of the furnace body 10. The numeral 14 denotes small openings through the furnace shell 1 and the refractory lining. These openings 14 may be filled with porous refractory material of desired. The numeral 21 denotes a lance for oxygen, the numeral 22 molten metal, the numeral 23 slag and the numeral 24 reducing agent. Upon rotation of the rotary furnae thus constructed, the metal 22, slag 23 and the reducing agent 24 remain in a zone A, while a zone B is devoid of material at all times.

Figure 13:
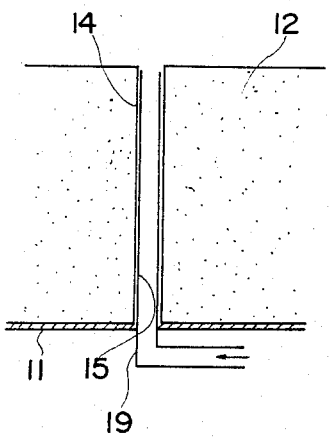
FIGS. 13 (a) (b) (c) show various forms of small holes provided to the furnace body.
Figure 13:
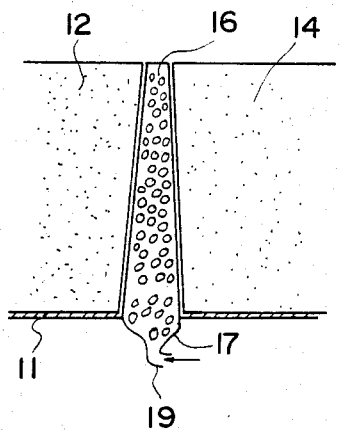
Figure 13:
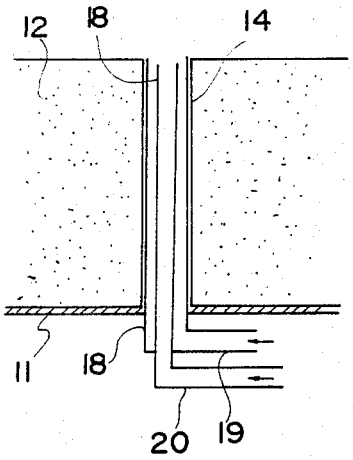

FIG. 13 shows various forms of small openings 14 in the furnace body 10 wherein (a) shows the opening 14 lined with a pipe 15 which is connected in turn to a gas pipe 19, (b) shows the opening 14 filled with porous refractory material 16 lined with a furnace shell 17 which is connected in turn to a gas pipe 19, and (c) shows the small opening 14 lined with a dual pipe consisting of an outer pipe 18 and an inner pipe **18*a* connected in turn to gas pipes 19, 20** respectively.

The present invention is characterized in that the gas as tabulated in Table 2 is blown through the small openings of the rotary furnace.

TABLE 2

| Object | blowing medium | blowing position | main blowing period | type of small openings (FIG. 13) |
|---|---|---|---|---|
| 1. gas for cooling of refractory | combination of waste gases, air, $H_2Ar$ and $H_2O$ | into free space (between gas and metal) gases can be blown into metal or slag | any time during refining | type (a), (b), (c) |

TABLE 2-continued

| Object | blowing medium | blowing position | main blowing period | type of small openings (FIG. 13) |
|---|---|---|---|---|
| 2. Gas for promotion of melting | $O_2$ + Pulverizing coal<br>$O_2$ + CWM<br>$O_2$ + Coal Oil Mixture<br>$O_2$ + Oil<br>$O_2$ + Natural Gas<br>L.P.G. (Liquid Propane Gas) | into metal, slag or free space, gases can be blown into between gas and metal | during smelting and reduction | type (c) |
| 3. Decarburizing gas | Combination is air + $N_2$, Ar, He<br>Ar or $N_2$ + $O_2$, wastegas<br>$H_2O$ + Ar or $N_2$ | into metal | during the latter half reduction period and during separation of metal slag | type (a) (b) or (c) |

The present invention may give rise to the following results.

(1) Coal and coke available readily at lower costs can be used and heat recovery can be facilitated, Gross emergy consumption can be reduced by about 25 percent as compared to the conventional electric furnace method, with resulting cost saving.

(2) When the carbonaceous reducing agent is burned in the rotary furnace for smelting reduction, the carbonaceous reducing agent layer height and the holding time are specified, and the skimmer is provided to the tapping hole or mouth for recirculation of the carbonaceous reducing agent.

In this manner, ferrochromium can be manufactured from readily available and inexpensive coal at increased thermal efficiency and metal recovery rate.

(3) Since the gas in blown through the small openings in the furnace body for cooling the surface of refractory material, the service life of the refractory material can be prolonged markedly, thus reducing the repair costs and down time necessary for such repair.

(4) Since fuel and oxygen are blown through the small openings to promote the smelting of the raw materials, the blowing time can be reduced and productivity improved.

(5) The metal yielded can be decarburized, so that it is possible to obtain from high carbon ferrochromium with e.g. 7 to 8 percent carbon to moderate carbon ferrochromium with 3 to 4 percent carbon.

The present invention will be described further by referring to several examples thereof.

EXAMPLE 1

This Example refers to the production of high carbon ferrochromium. The apparatus shown in FIG. 2 is used for production of 1 ton of high carbon ferrochromium.

The rotary furnace 2 open at one end (inside diameter, 1 m; outside diameter, 2 m; length, 3 m) was rotated at 8 rpm with the axis horizontal. The raw materials, fluxes, coke and coal were pre-heated to about 500° C. in the rotary kiln 1, mixed together and charged through the inlet of the rotary furnace 2. The mixture consisted of 1900 kg of chromium ores, 254 kg of calcined lime, 26 kg of silica, 5 kg of mill scale, 400 kg of coal and 400 kg of coke, with the size of the raw materials and fluxes being less than 20 mm and the size of coke and coal being in the order of 5 to 12 mm.

Oxygen was blown onto the surface of coke and coal from a water-cooled lance 21 inclined 15 degrees relative to the rotary axis of the rotary furnace 2. Oxygen blow was started at the rate of 10 $m^3$ per minute and the materials were smelted in about 50 minutes. The slag temperature at this time was 1650° C. After about ten minutes, 300 kg of additional coke and coal were charged at the charging rate of 10 kg per minute for forming a bed layer of predetermined thickness on the slag surface. Oxygen was blown at 6 $Nm^3$/minute during the 50–60 minute interval and at 3 $Nm^3$/minute during the 65 to 80 minute interval. Oxygen blow was terminated in 80 minutes and the molten metal was tapped out. The slag temperature at this time was 1720° C.

The metal and slag of the following weight and chemical composition (wt. percent) were obtained.

| | Cr | Fe | Si | C |
|---|---|---|---|---|
| metal, 1000 kg | 53.5% | 36.5% | 1% | 8% |

| | $Cr_2O_3$ | $SiO_2$ | CaO | $Al_2O_3$ | MgO |
|---|---|---|---|---|---|
| slag, 1200 kg | 0.5% | 20% | 31% | 31% | 27% |

A skimmer was attached at the time of tapping to the tapping hole or mouth to cause residual excess coke to remain in the furnace for recirculation.

The gas generated in the process of smelting reduction of the ores had the composition $CO/CO_2$ equal to 20/80 and was exhausted at about 1200° C. The gas was conducted to a rotary kiln 1 (capacity, 1500 kg charge/-hour; inside diameter, 1 m; length, 10 m; 1 rpm) for preheating 800 kg per hour of Cr ores, 13 kg per hour of silica, 127 kg per hour of calcined lime and 25 kg per hour of mill scale. The raw materials and the fluxes were charged into the rotary furnace and the discharge temperature thereof from the rotary kiln 1 was kept at 500° C. by blowing the air into the rotary kiln at a rate of 1.5 $Nm^3$ per minute. The gases exhausted at 500° C., or thereabouts from the rotary kiln 1 were passed through the heat exchanger 4 for heat recovery at a rate of 20000 kcal/hour.

EXAMPLE 2

This Example refers to the production of high carbon ferrochromium. The apparatus shown in FIG. 3 was used for production of 1 ton of high carbon ferrochromium.

The rotary furnace 2 open at both ends (inside diameter, 1 m; outside diameter, 2 m; length, 3 m) was rotated at 8 rpm with the axis thereof horizontal coke and C-containing chromium or pellets were charged into the furnace at 1200° C. after pre-reduction in the rotary kiln 1. Following pre-reduction, the raw materials had the following chemical composition (wt. percent) and mixture ratio.

C-containing Cr pellets (Cr ores, 1900 kg; calcined lime, 254 kg; silica, 26 kg; mill scale, 5 kg; contained coke, 200 kg); coke, 200 kg.

Chemical composition. M-Cr, 13%; $Cr_2O_3$, 26%, M.Fe, 16%, $SiO_2$, 7%; MgO, 15%; $Al_2O_3$, 13%.

Figure 4:
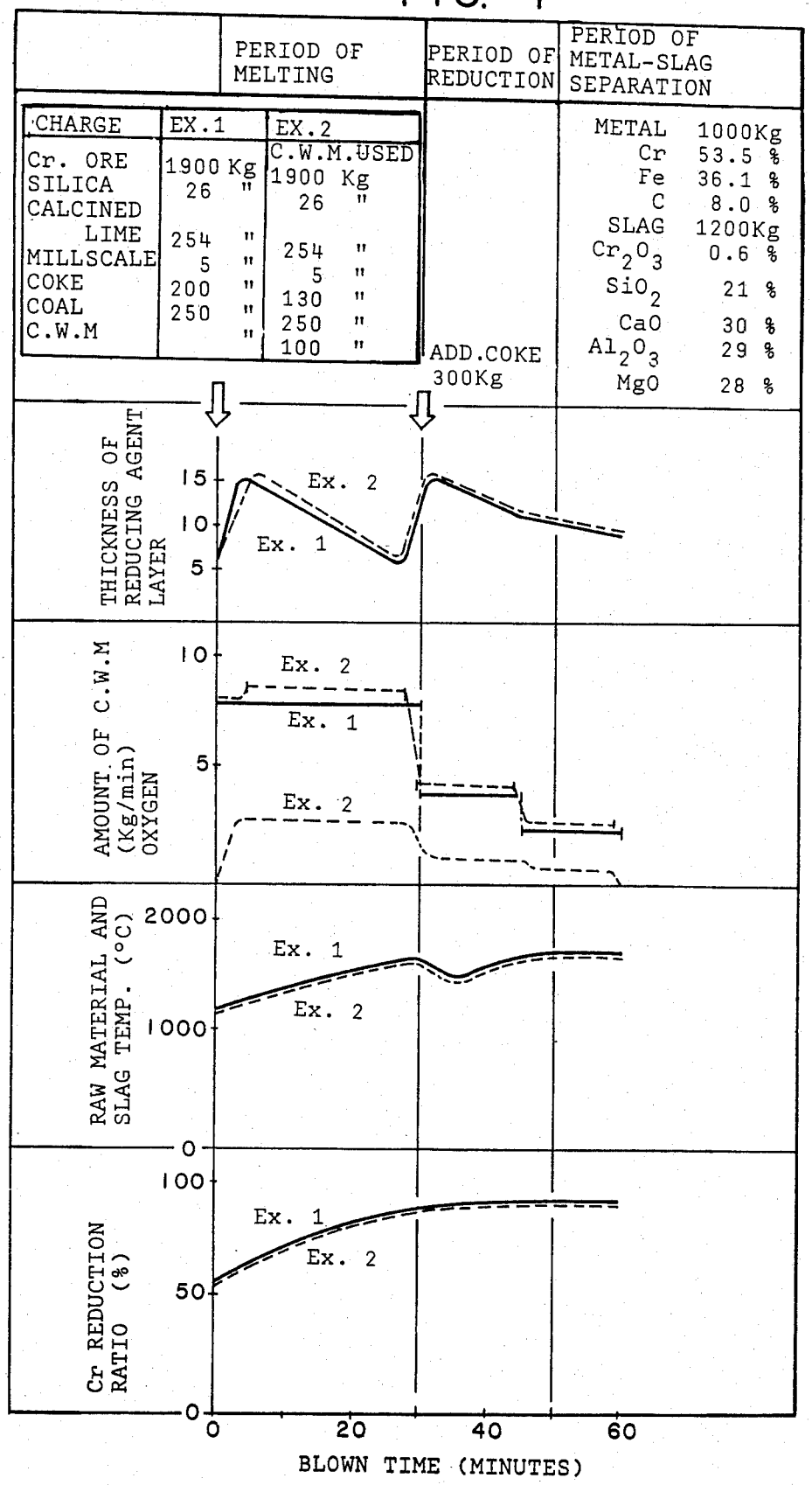
FIG. 4 is a chart showing the reducing agent layer thickness and other operating parameters for the second embodiment with respect to elapsed time.

Oxygen and oxygen-enriched air were blown from both furnace ends onto the surface of the reducing agent and C.W.M. (coal water mixture or slurry or emulsion) was blown through one furnace end onto the same surface. FIG. 4 shows examples of the oxygen blown pattern, thickness transition of the reducing agent on the surface of molten material, C.W.M. blow pattern, changes in slag temperature and changes in Cr reduction rate.

The materials were melted in about 30 minutes. The slag temperature at this time was 1650° C. 300 kg of additional coal and coke were charged at this time for forming a bed layer higher than 5 cm on the slag surface. The material was tapped out after blow was terminated in 60 minutes. The slag temperature at this time was 1750° C. and the metal and slag having the following weight and chemical composition (wt. percent) were obtained.

| | Cr | | Fe | | C |
|---|---|---|---|---|---|
| metal, 1000 kg | 53.5% | | 36.1% | | 8.0% |
| 8.0% | $Cr_2O_3$ | $SiO_2$ | CaO | $Al_2O_3$ | MgO |
| slag, 1200 kg | 0.6% | 21% | 30% | 29% | 28% |

A skimmer was provided at the time of tapping to the tapping hole or mouth to cause the residual excess coke to remain in the furnace for recirculation of the reducing agent.

The gases evolved in the process of smelting reduction of the ores were exhausted at about 1200° C. These gases were conducted to a rotary kiln 1 (processing capacity, 2000 kg charge/hour; inside diameter, 1.0 m; length, 10 m; 1 rpm) while 30 $Nm^3$ per minute of air and 6 kg per minute of heavy oil were blown for heat compensation to carry out pre-reduction of the raw materials (C-containing Cr pellets) and heating of coke. The gases exhausted at about 800° C. from the rotary kiln 1 were passed through the heat exchanger 4 for heat recovery of about 20000 kcal per hour.

FIG. 4 shows the relation between the blowing time, thickness of the layer of reducing agent and the amount of coal water mixture.

EXAMPLE 3

This Example refers to the production of high carbon ferrochromium. The apparatus shown in FIG. 5 was used for production 1 ton of high carbon ferrochromium.

A rotary furnace 2 open at one end with inside diameter of 1 m, outside diameter of 2 m and length of 3 m was placed with its axis horizontal and rotated at 8 rpm. The raw materials, fluxes, coke and coal, heated to 1000° C. in the shaft type reducing furnace 7, was mixed at a rate of 1900 kg of C-containing Cr pellets, 254 kg of calcined lime, 26 kg of silica, 5 kg of mill scale, 400 kg of coke and 250 kg of coal, and charged into the furnace.

In the rotary furnace, oxygen was blown onto the surface of coke and coal through a water-cooled lance 21 inclined 15° relative to the rotary axis. Oxygen blow was started at 10 $Nm^3$/min. and the material was smelted in about 40 minutes. The slag temperature at this time was 1650° C. Additional coke and coal were charged since this time at the rate of 10 kg/min. for forming a bed layer of certain thickness on the slag surface. Oxygen was blown at 6 $Nm^3$/min. in the 40 to 55 minute period and at 3 $Nm^3$/min. in the 55 to 70 minute period. The blowing was terminated in 70 minutes and the material was tapped out. The slag temperature at this time was 1750° C. and the metal and slag having the following weight and chemical composition (wt. percent) were obtained.

| | Cr | Fe | Si | C |
|---|---|---|---|---|
| metal, 1000 kg | 53.5% | 36.2% | 1.5% | 8.2% |
| | $Cr_2O_3$ | $SiO_2$ | CaO | $Al_2O_3$ | MgO |
| slag, 1200 kg | 0.5% | 22% | 30% | 29% | 27% |

A skimmer was provided at the tapping hole or mouth to cause the residual excess coke to remain in the furnace at the time of tapping for recirculation of such coke.

The gases evolved in the process of smelting reduction of the ores were conveyed to a heat storage chamber 81 of a reformer 8 where a small amount of natural gas was mixed into the gases and the resulting mixture was burned to heat the bricks to about 1400° C. for heat storage. Exhaust gases from the shaft furnace 70 mixted with the natural gas were passed through this reforming heat storage chamber 82 for producing reducing gases by reforming at about 1250° C. The resulting reducing gases were supplied into shaft type reducing furnace 7 for reducing FeO in the pellets to Fe. The raw materials were discharged at about 1050° C. and charged into rotary furnace 2. The exhaust gases from the shaft type reducing furnace 7 were returned into the reformer 8 for recirculation.

The C-containing Cr pellets, resulting from pre-reduction in the shaft type reducing furnace 7, had the chemical composition of 43 wt. % of $Cr_2O_3$, 7 wt. % of $Sio_2$, 15 wt %. of MgO and 13 wt. % of $Al_2O_3$.

The exhaust gases at about 1200° C. from the reformer 8 were passed through heat exchanger 4 for heat recovery of 200,000 kcal per hour.

Table 3 tabulates recorded values as obtained when a rotary kiln or a shaft furnace was used, for pre-heating or pre-reduction, while Table 4 tabulates typical values for total energy consumption and costs for the cases of the inventive method and the electric arc furnace method.

It is seen from these Tables that the inventive method enables ferrochromium to be produced by using inexpensive readily available coal and without using expensive electric power thus realizing energy saving.

TABLE 3

| | | Example-1 rotary kiln (pre-heating) | | | | Example-2 rotary kiln (Cr, 55% Fe 50% reduction) | | |
|---|---|---|---|---|---|---|---|---|
| | | Case (1) $O_2$ – Coke | Case (2) $O_2$ + Air Coke + Coal | Case (3) C-containing | Case (4) Oxy-fuel | Case (1) $O_2$ – Coke | Case (2) $O_2$ – Coke | Case (3) $O_2$ + Air – Coke + Coal |
| Pre-heated | Cr Ore | 1,900 Kg | 1,900 Kg | 1,900 Kg | 1,900 Kg | 1,900 Kg | 1,900 Kg | 1,900 Kg |

TABLE 3-continued

| | | | | | | | | |
|---|---|---|---|---|---|---|---|---|
| or pre-reduced materials | Silica | 26 Kg | 26 Kg | 26 Kg | 26 Kg | 26 Kg | 26 Kg | 26 Kg |
| | Calcined lime | 254 Kg | 254 Kg | 254 Kg | 254 Kg | 254 Kg | 254 Kg | 254 Kg |
| | mill scale | 5 Kg | 5 Kg | 5 Kg | 5 Kg | 5 Kg | 5 Kg | 5 Kg |
| | Coke | 750 Kg | 400 Kg | 550 Kg | 260 Kg | 440 Kg | 200 Kg | 200 Kg |
| Carbon materials | Coke | — | — | — | — | — | — | — |
| | Coal | — | 400 Kg | 250 Kg | 400 Kg | — | 250 Kg | 280 Kg |
| Fuel | $O_2$ | 650 $Nm^3$ | 590 $Nm^3$ | 630 $Nm^3$ | 670 $Nm^3$ | 400 $Nm^3$ | 380 $Nm^3$ | 420 $Nm^3$ |
| | $O_2$-enriched air | — | 200 $Nm^3$ | — | — | — | 100 $Nm^3$ | — |
| | Oxyfuel | — | — | — | 200 Kg | — | — | — |
| Pre-heating temperature of raw materials | | 490° C. | 510° C. | 500° C. | 500° C. | 1190° C. | 1210° C. | 1200° C. |
| Pre-reduction ratio | | — | — | — | — | Cr:52% Fe:80% | Cr:55% Fe:85% | Cr:54% Fe:80% |
| Metal | weight | 990 Kg | 990 Kg | 1,050 Kg | 1,000 Kg | 1,010 Kg | 990 Kg | 1,000 Kg |
| | Composition | 53.5% Cr | 53.8% Cr | 54.5% Cr | 53.2% Cr | 53.4% Cr | 54.2% Cr | 53.8% Cr |
| | | 36.0% Fe | 35.5% Fe | 34.5% Fe | 37.5% Fe | 37.2% Fe | 36.4% Fe | 35.8% Fe |
| | | 7.5% C | 7.8% C | 8.0% C | 7.8% C | 76% C | 8.0 C | 7.9% C |
| Slag | weight | 1,150 Kg | 1,200 Kg | 1,200 Kg | 1,250 Kg | 1,230 Kg | 1,250 Kg | 1,090 Kg |
| | Composition | 0.5% $Cr_2O_3$ | 0.5% $Cr_2O_3$ | 0.5% $Cr_2O_3$ | 0.6% $Cr_2O_3$ | 0.7% $Cr_2O_3$ | 0.6% $Cr_2O_3$ | 0.8% $Cr_2O_3$ |
| | | 22% $SiO_2$ | 20% $SiO_2$ | 20% $SiO_2$ | 21% $SiO_2$ | 22% $SiO_2$ | 20% $SiO_2$ | 21% $SiO_2$ |
| | | 30% CaO | 30% CaO | 30% CaO | 31% CaO | 30% CaO | 29% CaO | 30% CaO |
| | | 31% $Al_2O_3$ | 29% $Al_2O_3$ | 29% $Al_2O_3$ | 30% $Al_2O_3$ | 31% $Al_2O_3$ | 32% $Al_2O_3$ | 30% $Al_2O_3$ |
| Heat recovery | | 20,000 Kcal/Hr | 20,000 Kcal/Hr | 20,000 Kcal/Hr | 20,000 Kcal/Hr | 155,000 kcal/Hr | 165,000 kcal/Hr | 160,000 kcal/Hr |

| | | | Example-2 rotary kiln (Cr, 55% Fe 50% reduction | Example-3 shaft furnace, only 85% Pre-reduction | | | |
|---|---|---|---|---|---|---|---|
| | | | Case (4) C-containing | Case (1) Oxy-fuel | Case (2) $O_2$ + Air – Coke | Case (3) C-containing | Case (4) Oxy-fuel |
| Pre-heated or pre-reduced materials | Cr Ore | | 1,900 Kg | 1,900 Kg | 1,900 Kg | 1,900 Kg | 1,900 Kg |
| | Silica | | 26 Kg | 26 Kg | 26 Kg | 26 Kg | 26 Kg |
| | Calcined lime | | 254 Kg | 254 Kg | 254 Kg | 254 Kg | 254 Kg |
| | mill scale | | 5 Kg | 5 Kg | 5 Kg | 5 Kg | 5 Kg |
| | Coke | | 130 Kg | 480 Kg | 230 Kg | 200 Kg | 160 Kg |
| Carbon materials | Coke | | — | — | — | — | — |
| | Coal | | 250 Kg | — | 270 Kg | 300 Kg | 270 Kg |
| Fuel | $O_2$ | | 430 $Nm^3$ | 420 $Nm^3$ | 410 $Nm^3$ | 440 $Nm^3$ | 450 $Nm^3$ |
| | $O_2$-enriched air | | — | — | 100 $Nm^3$ | — | — |
| | Oxy-fuel | | 100 Kg | — | — | — | 100 Kg |
| Pre-heating temperature of raw materials | | | 1210° C. | 1,000° C. | 1,050° C. | 1,040° C. | 1,050° C. |
| Pre-reduction ratio | | | Cr:56% | Fe:80% | Fe:84% | Fe:85% | Fe:85% |
| Metal | Weight | | 1,010 Kg | 1,000 Kg | 1,010 Kg | 990 Kg | 990 Kg |
| | Composition | | 54.0% Cr | 53.1% Cr | 53.4% Cr | 53.6% Cr | 53.6% Cr |
| | | | 34.3% Fe | 36.7% Fe | 36.1% Fe | 36.2% Fe | 36.4% Fe |
| | | | 8.0% C | 7.8% C | 7.7% C | 7.9% C | 7.8% C |
| Slag | Weight | | 1,200 Kg | 1,300 Kg | 1,180 Kg | 1,200 Kg | 1,100 Kg |
| | Composition | | 0.5% $Cr_2O_3$ | 0.6% $Cr_2O_3$ | 0.8% $Cr_2O_3$ | 0.7% $Cr_2O_3$ | 0.6% $Cr_2O_3$ |
| | | | 20% $SiO_2$ | 21% $SiO_2$ | 23% $SiO_2$ | 20% $SiO_2$ | 22% $SiO_2$ |
| | | | 33% CaO | 32% CaO | 31% CaO | 33% CaO | 33% CaO |
| | | | 29% $Al_2O_3$ | 27% $Al_2O_3$ | 28% $Al_2O_3$ | 28% $Al_2O_3$ | 30% $Al_2O_3$ |
| Heat recovery | | | 163,000 kcal/Hr | 210,000 kcal/Hr | 220,000 Kcal/Hr | 210,000 Kcal/Hr | 220,000 Kcal/Hr |

TABLE 4

| | | | electric arc furnace method (conventional) | inventive (coal used) | inventive (Coal to Coke ratio 50:50) |
|---|---|---|---|---|---|
| Main | *electric power 2450 Kcal/KWH | | $3,100 \times 2450 = 7595 \times 10^3$ | — | — |
| Energy | Coke | 7200 Kcal/Kg | $395 \times 7200 = 2844 \times 10^3$ | — | $438 \times 17200 = 3154 \times 10^3$ |
| | Coal | 7500 Kcal/Kg | | $875 \times 7500 = 6,562 \times 10^3$ | $437 \times 7500 = 3278 \times 10^3$ |
| | Oxygen | 1600 Kcal/$Nm^3$ | | $733 \times 1600 = 1173 \times 10^3$ | $1173 \times 10^3$ |
| Total energy consumption (ratio) | | | $10,439 \times 10^3$ Kcal (100) | $7735 \times 10^3$ Kcal (74) | $7,605 \times 10^3$ Kcal (73) |

*Conversion efficiency from heavy oil to electric power 35%.

EXAMPLE 4

This Example refers to the production of high-carbon ferrochromium.

The rotary furnace as shown in FIG. 2 (inside diameter, 0.42 m; outside diameter, 0.76 m; length, 1.4 m; lined with chrome-magnesite bricks; tilted 20° relative to the horizontal and thus in distinction from the furnace shown in FIG. 2; and rotating at 8 rpm) was used. The furnace body had an inlet for raw materials and a water-cooled oxygen blow lance 21 at one end.

The raw materials, fluxes and coke were mixed at the rate of 30 kg of Cr ores, 6.8 kg of calcined lime and 20 kg of coke, and charged into the furnace, with the size of the respective materials in the range of 5 to 15 mm.

Oxygen was blown into the furnace through a water-cooled lance 21 mounted on the rotary axis of the furnace. The materials were smelted and reduced by heat of coke combustion. Oxygen blowing was started at 1.4 $Nm^3$/min. and changed to 1.1 $Nm^3$/min. after 20 minutes, to 0.8 $Nm^3$/min. after 35 minutes, and to 0.6 $Nm^3$/min. after 50 minutes.

Additional coke was supplied continuously at rate of 1000 gr/min. after lapse of 20 minutes since the start of oxygen blowing in order to keep the thickness of the coke bed layer at about 10 cm.

The materials were tapped out after 70 minutes since the start of blowing. At the time if tapping, a skimmer was provided at the tapping hole or mouth at a spacing of 5 cm from the lining so that part of excess coke and a portion of the slag remained in the furnace for recirculation while the metal and the major portion of the slag were tapped out.

The similar operations were carried out ten times consecutively with the initial coke feed of 10 kg. As a result, the metal and slag of the following weight and chemical composition were obtained. The metal recovery rate was 92 percent.

| | mean weight for ten operations | Cr | | Fe | | C |
|---|---|---|---|---|---|---|
| metal | 13.8 Kg | 53.5% | | 37.1% | | 8.0 |
| | mean weight for ten operations | $Cr_2O_3$ | $SiO_2$ | CaO | $Al_2O_3$ | MgO |
| slag | 25.0 Kg | 0.6% | 18% | 30% | 31% | 27% |

Figure 9:
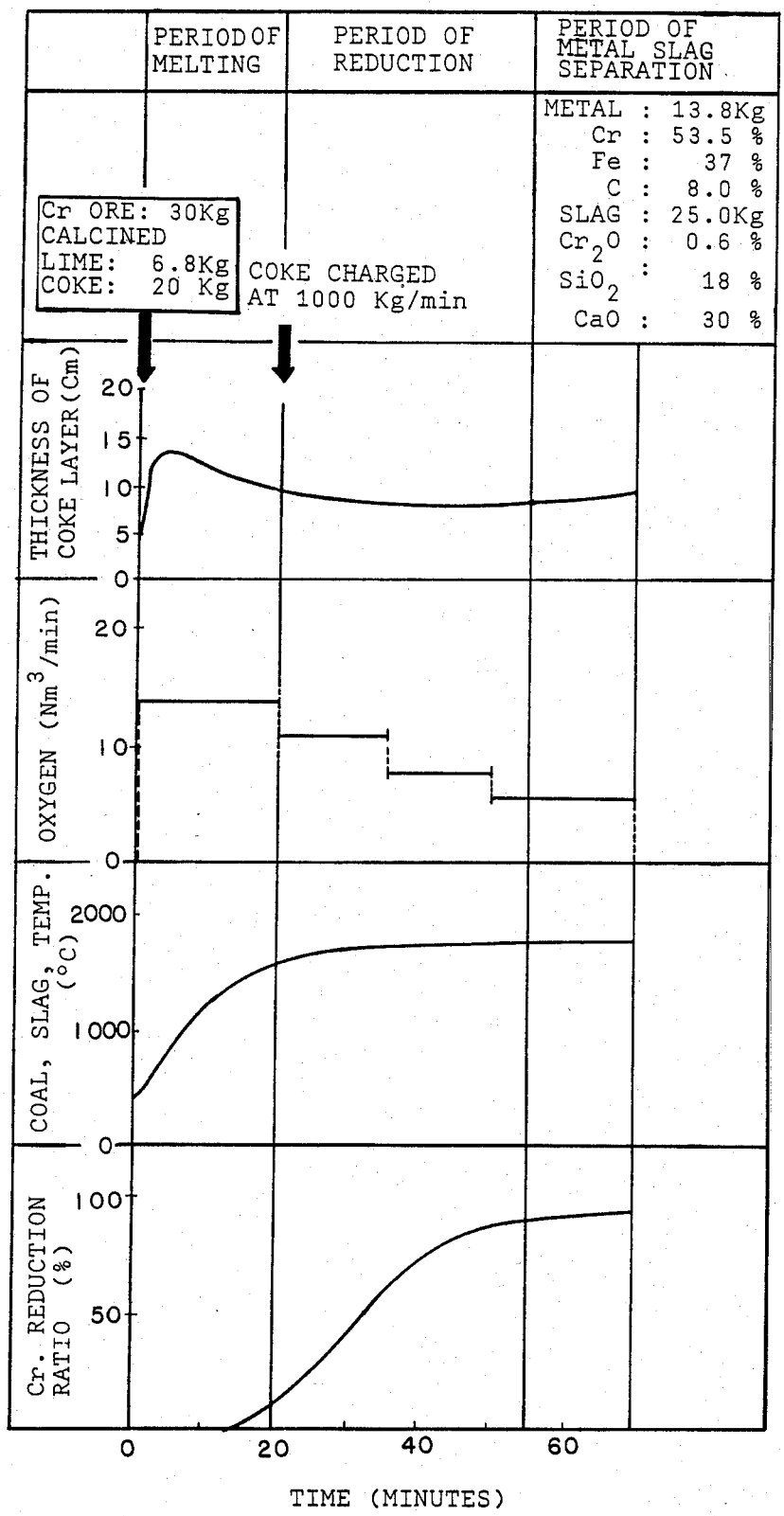
FIG. 9 shows the various operating parameters for the fourth embodiment with respect to elapsed time.
Figure 10:
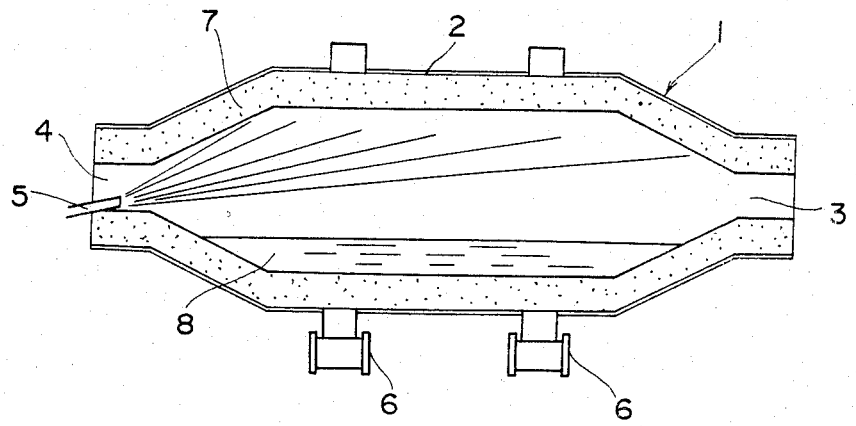
FIG. 10, is a longitudinal section through a conventional rotary furnace.

FIG. 9 is a chart showing the relation between the blow time and various conditions used in the Example 4.

EXAMPLE 5

This Example refers to the production of high-carbon ferrochromium.

The apparatus similar to that used in Example 4 was used. Pre-reduced Cr pellets, calcined lime and coke were mixed in the ratio of 30 kg of pellets, 5.8 kg of calcined lime and 20 kg of coke, and charged into the furnace. The pellets to be reduced had the following chemical composition (wt. percent).

M.-Cr, 21%; $Cr_2O_3$, 10%; M.Fe, 18%' $SiO_2$, 6.5%; MgO, 15%; $Al_2O_3$, 13%.

Oxygen was blown into the furnace through a water-cooled lance monated on the rotary shaft of the furnace body. Oxygen blowing was started at 1.4 $Nm^3$/min. and the materials were smelted in 20 minutes. Slag temperature reached 1650° C. Oxygen was blown at 1.1 $Nm^3$/min. in the 20 to 30 minute interval, at 0.8 $Nm^3$/min. in the 30 to 40 minute interval and at 0.6 $Nm^3$ in the 40 to 50 minute interval. Additional coke was charged consecutively at the rate of 1000 gr/min. since the lapse of 20 minutes in order to keep the coke bed about 10 cm in thickness.

The slag temperature reached 1750° C. after 50 minutes since the start of oxygen blowing. The materials were tapped out at this time. A skimmer was provided at the tappering hole or mouth at a spacing of 5 cm from the lining so that, while the slag, and metal were tapped out, residual excess coke and a portion of the slag were caused to remain in the furnace for recirculation.

Similar operations were carried out ten times on end with the initial coke feed of 10 kg. As a result, the metals and slags of the following weight and chemical composition (wt. percent) were obtained. The metal recovery rate was 93 percent.

| | mean weight for ten operations | Cr | | Fe | | C |
|---|---|---|---|---|---|---|
| metal | 13.95 kg | 53.5% | | 36.5% | | 8.1% |
| | | $Cr_2O_3$ | $SiO_2$ | CaO | $Al_2O_3$ | MgO |
| slag | 24.50 kg | 0.5% | 17.5% | 29.0% | 30% | 28% |

As is evident from the foregoing Examples 4 and 5, according to the method of the present invention, ferrochromium can be produced without using expensive electric power and by resorting to less costly coal and the heat efficiency as well as metal recovery rate may be increased markedly.

EXAMPLE 6

This Example refers to the production of medium carbon ferrochromium.

Figure 15:
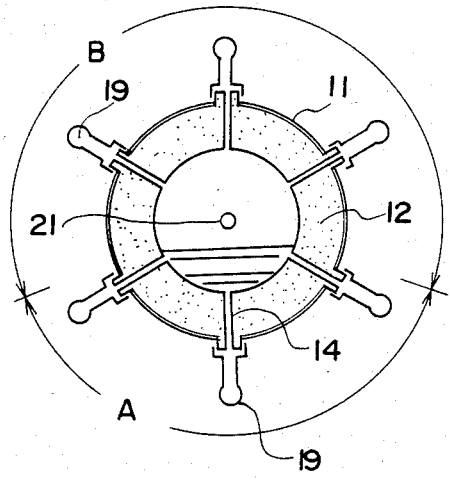
FIG. 15 is a section taken along line B—B of FIG. 14.

The rotary furnace as shown in FIGS. 14 and 15 (inside diameter, 1 m; outside diameter, 2 m; length, 5 m; lined on its inner surface with refractory chrome-magnesite bricks 12 to a thickness of 30 cm; open at both ends) was rotated at 8 rpm with the rotary axis horizontal. Thirty small openings 14 (five at intervals of 50 cm lengthwise and six at equiangular distance circumferentially) were formed through the furnace shell 11 and the refractory lining 12 into the furnace, with each of these openings 14 connecting to a pipe 19 communicating in turn with a gas source.

Preheated ores, fluxes, coal and coke more mixed at a ratio of 1900 kg of Cr ores, 254 kg of calcined lime, 26 kg of silica, 5 kg of mill scale 400 kg of coal and 400 kg of coke, and charged into the furnace.

Then, oxygen was blown through oxygen blow lance 21, at the same time that air was introduced through the small orifices associated with the metal and slag zone in the furnace (zone A) and with free space zone (zone B), for the purpose of promoting the melting of the materials and cooling the refractory surface, respectively.

The materials were melted in about 28 minutes after start of oxygen blowing, when the slag temperature reached 1620° C. At this time, 300 kg of additional coke was charged, while the gas blown through the small openings 14 into the metal and slag zone and the free space zone was now switched from air to waste gases (waste gas plus $N_2$). The slag temperature reached 1710° C. in about 60 minutes since the start of oxygen blowing. At this time, 990 kg of metal was produced and the chemical composition of the metal was 54.0% of Cr. 8.8% of C and 36.5% of Fe.

Since the lapse of 60 minutes until termination of smelting operation, air and $O_2$ were introduced through openings 14 associated with the metal and slag zone A while exhaust gases were introduced through openings 14 associated with free space zone B. Blowing was completed in 80 minutes and the materials were tapped out. The metal and slag had the following weight and chemical composition (weight percent).

metal: 940 kg chemical composition; 55.2%, Cr; 39.0%, Fe; and 1.2% Si

Slag: 1300 Kg

Figure 16:
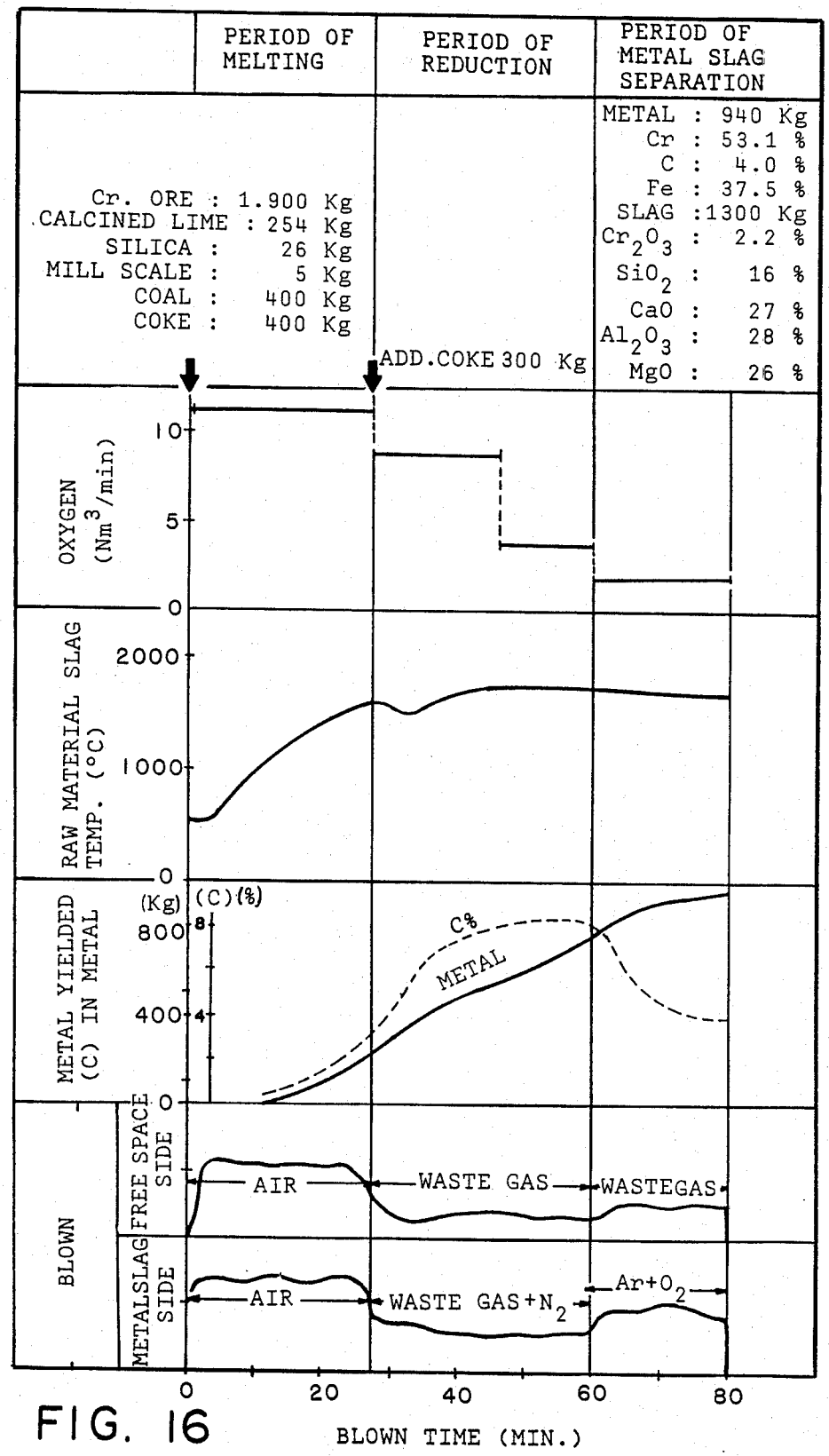
FIG. 16 shows various operating parameters for the sixth embodiment of the invention with respect to time elapsed.

Chemical composition; 2.2%, $Cr_2O_3$; 16% $SiO_2$; 27% CaO; 28% $Al_2O_3$; and 26% MgO In FIG. 16, the amount of blown gases, the amount of yielded metal, material and slag temperatures and the amount of blown oxygen used for Example 6 are plotted against lapsed time.

EXAMPLE 7

This Example refers to the production of carbon unsaturated high carbon ferrochromium.

The rotary furnace as shown in FIG. 17 (inside diameter, 1 m; outside diameter, 2 m; length, 3 m; lined with chrome magnesite bricks on the inner surface to a thickness of about 30 cm; opened at one end) was rotated at 8 rpm with the rotary axis inclined at 20°. Thirty small openings 14 (five at intervals of 50 cm lengthwise and six at equal angular distances circumferentially) were provided through the furnace shell 11 and the refractory lining 12 for opening into the furnace inside. Each small opening 14 was connected to a gas source by a dual pipe (outside diameter, 15 mm, inside diameter, 11 mm) consisting of an outer pipe 18 and an inner pipe 18*a*.

Figure 18A:
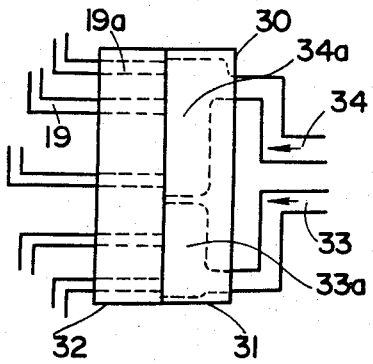
FIGS. 18 (a) (b) (c) and 19 (a) (b) (c) are side views and exploded plan views, respectively, showing examples of connection between gas source and the dual pipe according to the seventh embodiment.
Figure 18B:
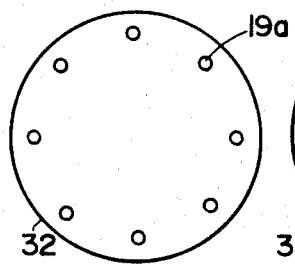
Figure 18C:
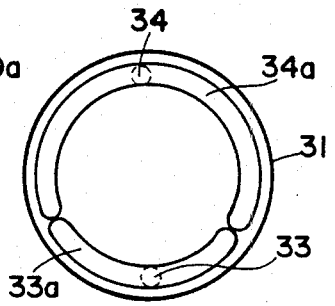
Figure 19A:
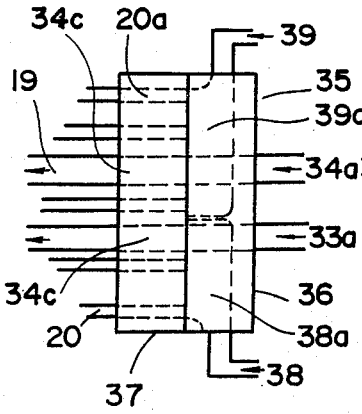
Figure 19B:
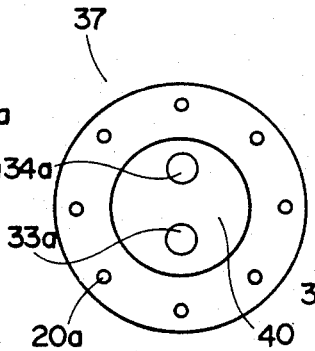
Figure 19C:
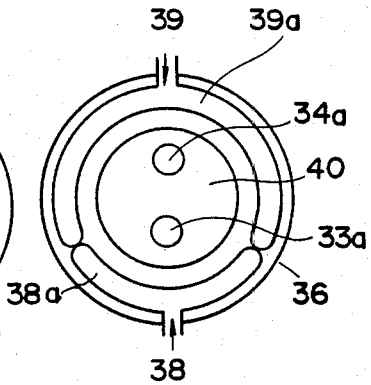

Examples of connection between the dual pipe and the gas source are shown in FIGS. 18 and 19. FIGS. 18(*a*) (*b*) and (*c*) show the connection between the gas pipe 19 of the outer pipes 18 and the gas source wherein a connection device 30 for the outer pipes consists of a fixed block 31 having a gas inlet 33 into the metal and slag zone, a gas inlet 34 into the free space zone and grooves 33*a*, 34*a* communicating therewith respectively, and a rotary block 32 having plural orifices 19*a* connecting to the gas pipe 19. These two blocks are connected to each other so that the rotary block 32 may be slid in contact with the end face of the fixed block 31 with rotation of the rotary furnace for supplying the gases from the gas source into the slag and metal zone and the free space zone via outer pipes 18.

FIGS. 19(*a*) (*b*) and (*c*) illustrate the connection between gas source and the gas pipes 20 for the inner pipe 18*a*. A connection device 35 for the inner pipes has a doughnut shaped fixed block 36 having a gas inlet 38 into the metal and slag zone, a gas inlet 39 into the free space zone and grooves 38*a*, 39*a* communicating therewith respectively, and a doughnut shaped rotary block 37 having plural orifices connecting to gas pipe 20 for the inner pipes. The rotary block 37 is rotated on the end face of the fixed block with rotation of the rotary furnace for supplying the gases from the gas source into the metal and slag zone and the free space zone by way of inner pipes 18. Gas conduits 33*a*, 34*a* for the outer pipes are mounted in a central hollow zone 40 of the doughnut shaped connection device 35.

Pre-heated ores and fluxes were mixed with coal and coke at the rate of 1900 kg of Cr ores, 254 kg of calcined lime, 26 kg of silica, 5 kg of mill scale, 400 kg of coal and 400 kg of coke, and charged into the above furnace through inlet 13. Oxygen was then blown through lance 21 while a pulverized coal and water mixture was supplied through outer pipes 18 associated with small openings 14 for the zones A and B and $O_2$ was introduced through the inner pipes 18*a* to promote the melting of the materials.

The materials were melted in about 20 minutes since the start of oxygen blow, and the slag temperature reached about 1600° C. 300 kg of additional coke was introduced at this time, and a mixture of a pulverized coal with water-coal slurry injection was supplied through the outer pipes 18 for the metal and the slag zone A, while steam was supplied through the outer pipes 18 and the inner pipes 18*a* for the free space zone B. The slag temperature reached about 1730° C. in about 55 minutes since the start of oxygen blowing. The metal was yielded in an amount of about 980 kg and had the chemical composition of 53.6 wt. % Cr, 8.5 wt. % C and 37.2 wt. % Fe.

Figure 20:
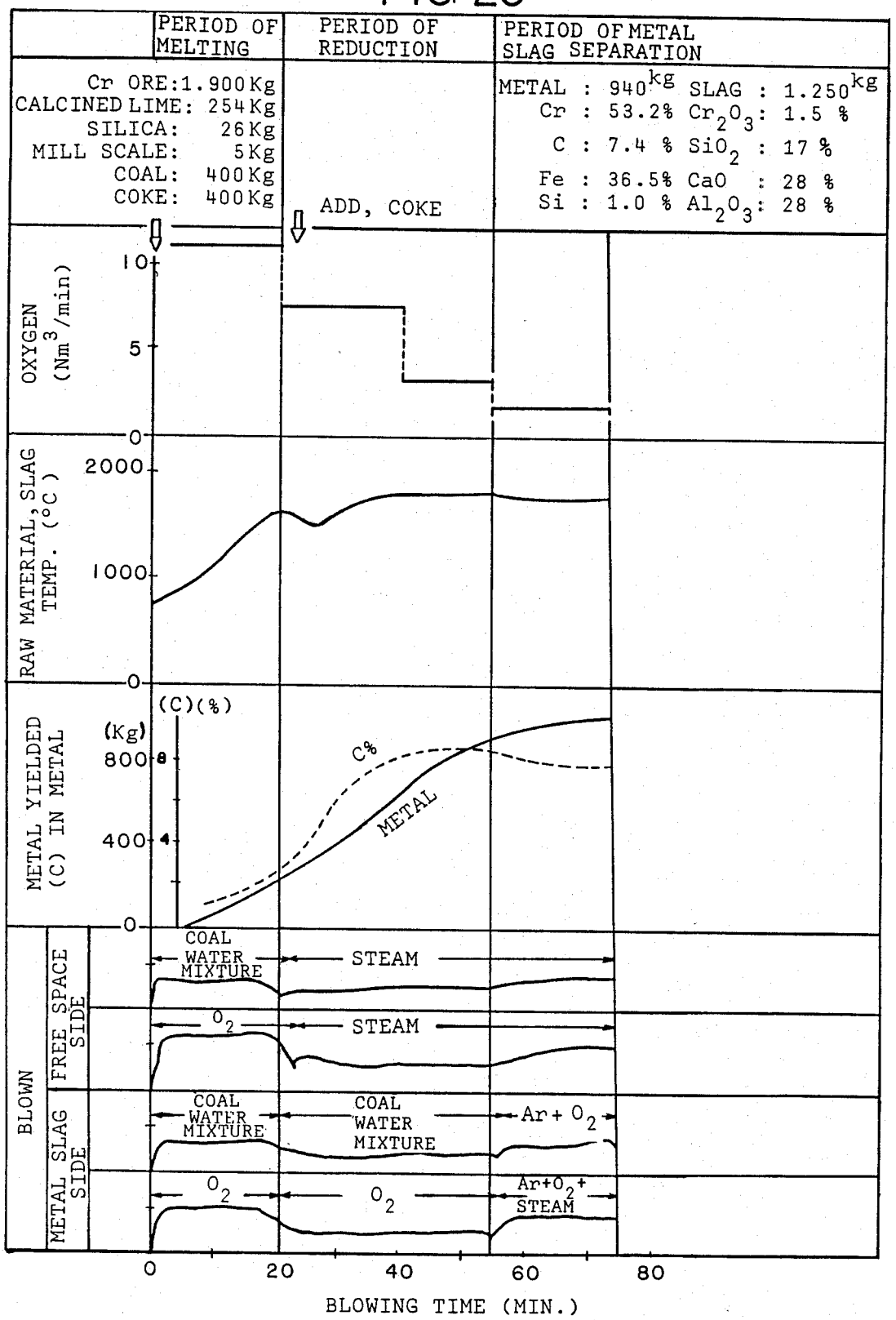
FIG. 20 is a chart showing various operating parameters for the seventh embodiment with respect to time.

Since this time until termination of smelting operation, air plus $O_2$ gas and air plus $O_2$ plus steam were supplied respectively through the outer pipes 18 and inner pipes 18*a* associated with the small openings 14 for the zone A, whereas steam was supplied through the outer pipes 18 and inner pipes 18*a* for the free space zone B. Blowing was terminated in about 75 minutes and the materials were tapped out. The metal and slag yielded had the following weight and chemical composition (wt. %).

metal yielded, 940 kg chemical composition, 53.2% Cr, 7.4% C, 36.5% Fe, 1.0% Si, slag, yielded, 1250 kg chemical composition, 1.5% $Cr_2O_3$; 17% $Sio_2$; 28% CaO; 28% $Al_2O_3$; 25% MgO FIG. 20, the amount of blown bases, the amount of metal yielded, material and slag temperatures and the amount of osygen blown for the above Example are plotted against lapsed time.

The foregoing refers to the case of blowing specific gases through the small openings in the furnace body. However, a variety of gases as tabulated in Table 2 may be employed within the scope of the invention. The foregoing refers to the case of the production of ferrochromium, but the present invention may be applied to the production of other metals with similar effects. While the examples of connection between the small openings in the furnace body and the gas source are shown in FIGS. 13, 18 and 19, the present invention is not limited thereto, but other means may be used provided that such means give rise to similar operation and results.

What is claimed is:

1. A horizontal or a non-steeply inclined rotary furnace used for smelting reduction or refining of metal alloys, said furnace comprising:

a furnace shell having inner and outer walls;

a refractory lining disposed on said inner wall, said lining defining a furnace inner surface;

a plurality of openings arranged in spaced relation on the circumference of the furnace outer wall, said openings extending through said furnace shell and said refractory lining, thereby defining a corresponding plurality of openings on the furnace inner surface;

said furnace defining an upper zone and lower zone during rotation, said upper zone being a free-space zone devoid of material at all times, and said lower zone comprising metal, slag, reducing agents and other materials; and each of said openings communicating with a source of fuel or fuel-oxygen mixture during the melting period in which the ores and other materials in the furnace are melted for yielding metal and slag, said fuel or fuel mix being introduced into said lower zone, thereby promoting the smelting of the raw materials.

2. The furnace of claim 1, wherein said openings are filled with a porous refractory material.

3. The furnace of claim 1, wherein said openings communicate with a source of oxygen or other oxidizing gases during the reducing period in which the carbon in the metal yielded is oxidized, said gases being introduced into both of said upper and lower zones;

said gas introduced into said upper zone functioning as a cooling gas to prevent overheating of the refractory lining; and said gas introduced into said lower zone functioning as a reducing agent, thereby promoting the decarbonization of the metal.

4. A horizontal or non-steeply inclined rotary furnace used for smelting reduction or refining of metal alloys, said furnace comprising:

a furnace shell having inner and outer walls;

a refractory lining disposed on said inner wall, said lining defining a furnace inner surface;

a plurality of openings arranged in spaced relation on the circumference of the furnace outer wall, said openings extending through said furnace shell and said refractory lining, thereby defining a corresponding plurality of openings on the furnace inner surface;

each of said openings housing a dual pipe structure, said structure comprising an inner pipe and an outer pipe;

said furnace defining an upper zone and lower zone during rotation, said upper zone being a free-space zone devoid of material at all times, and said lower zone comprising metal, slag, reducing agents and other materials; and each of said pipe structures communicating with a source of fuel and oxygen/air during the melting period in which the ores and other materials in the furnace are melted for yielding metal and slag, said outer pipe disposed for transporting the fuel and said inner pipe disposed for transporting the oxygen/air, thereby promoting the smelting of the raw materials.

5. The furnace of claim 4, wherein said pipe structure communicates with a source of oxygen or other oxidizing gases during the reducing period in which the carbon in the metal yielded is oxidized, both of said inner and outer pipes introducing said gases into both of said upper and lower zones;

said gas introduced into said upper zone functioning as a cooling gas to prevent overheating of the refractory lining; and said gas introduced into said lower zone functioning as a reducing agent, thereby promoting the decarbonization of the metal.

6. The furnace of claim 1, wherein the furnace shell is tiltably fixed with an opening formed only at one side thereof.

7. The furnace of claim 1, wherein the furnace is adapted for the production of ferrochromium.

8. The horizontal or non-steeply inclined rotary furnace used for smelting reduction or refining of metal alloys, said furnace comprising:

a furnace shell having inner and outer walls;

a refractory lining disposed on said inner wall, said lining defining a furnace inner surface;

a plurality of openings arranged in spaced relation on the circumference of the furnace outer wall, said openings extending through said furnace shell and said refractory lining, thereby defining a corresponding plurality of openings on the furnace inner surface;

each of said openings having a dual pipe structure, said structure comprising an inner pipe and an outer pipe;

a gas supply device connected to said inner pipes and said outer pipes, said gas supply device comprising:

(a) a connection device for said outer pipes which comprises the integrally connected arrangement of a gas inlet for the outer pipes, a fixed block having grooves in communication with each of said outer pipe gas inlets, and a rotary block having a plurality of gas blowing holes which are connected to said outer pipes;

(b) a connection device for said inner pipes which comprises the integrally connected arrangement of a gas inlet for the inner pipes, a donut-shaped fixed block having grooves in communication with each of said inner pipe gas inlets, and a donut-shaped rotary block having a plurality of gas blowing holes connected to said inner pipes; and a gas source connected to said connection devices wherein a gas is introduced from the gas source through said connection device for said outer pipes as well as said connection device for said inner pipes into the furnace by virtue of the sliding rotation of said rotary blocks on the end surface of said fixed block, which sliding rotation is caused by the rotation of the rotary furnace.

* * * * *